US005762240A

United States Patent [19]

Harris

[11] Patent Number: 5,762,240

[45] Date of Patent: Jun. 9, 1998

[54] METHOD AND APPARATUS FOR INSTALLING COVERS ON CLOTHES HANGERS

[75] Inventor: John J. Harris, Salinas, Calif.

[73] Assignee: CTS Foam Packaging, Inc., Covington, Ky.

[21] Appl. No.: 558,611

[22] Filed: Nov. 14, 1995

[51] Int. Cl.[6] ..... A47G 25/14; A41H 43/00

[52] U.S. Cl. ..... 223/1; 223/98

[58] Field of Search ..... 223/1, 85, 98, 223/120; 221/26, 27, 29; 81/485, 488

[56] References Cited

U.S. PATENT DOCUMENTS

| | | | |
|---|---|---|---|
| 1,292,512 | 1/1919 | Park | 221/27 |
| 3,341,003 | 9/1967 | Marsh | 221/26 |
| 3,460,727 | 8/1969 | Baughman | 223/98 |
| 5,328,065 | 7/1994 | Kolton | 223/85 |
| 5,433,355 | 7/1995 | Watkins | 223/1 |

OTHER PUBLICATIONS

WO 94/02836, IPO Document, Aug. 1984, Feldinger.
EPO 576,884, EPO Document, Jan. 1994, Bobr.–12.

*Primary Examiner*—Bibhu Mohanty
*Attorney, Agent, or Firm*—LaRiviere, Grubman & Payne

[57] ABSTRACT

Method for storing foam covers and for installing foam covers on clothes hangers, and apparatus to perform the method. A supply of foam covers are loaded on an insert spindle. The insert spindle is suspendable, and is formed to receive therein the hook of a clothes hanger. The insert spindle may further define a spreader to assist in spreading the slot of a foam cover over the hook of the clothes hanger. After suspending the insert spindle having at least one foam cover installed thereon, the operator inserts the hook of a clothes hanger into a hanger pocket formed at a lower end of the insert spindle. To install the cover onto the hanger the operator, by grasping the foam cover at either end thereof with the thumb and forefinger of each hand, and pulling the cover with a downward and outward motion, will cause the foam cover to slide down the insert spindle over the hook and onto the clothes hanger. Continuing with this downward and outward pulling, the operator snaps the foam cover into place over the ends of the clothes hanger.

8 Claims, 3 Drawing Sheets

METHOD AND APPARATUS FOR INSTALLING COVERS ON CLOTHES HANGERS

TECHNICAL FIELD

The present invention relates to a method for the rapid installation of covers on clothes hangers. More particularly, the present invention relates to a method for storing and shipping foam clothes hanger covers and for installing foam covers on clothes hangers.

BACKGROUND ART

Laundry and dry cleaning establishments, hereinafter referred to as "garment care establishments" have found that non-slip covers installed on a variety of clothes hangers provide an asset by eliminating the slippage inherent in the non-covered hangers presently manufactured for the industry. Clothes hangers typically have two arms joined at the center at a neck. The neck of the clothes hanger terminates in a device whereby the hanger may be suspended, usually a hook for use with clothes bars and the like. Non-slip covers for use in the garment care industry are often formed of foam. Foam covers for use with clothes hangers are available in a number of configurations, but are generally composed of a ribbon of foam, folded in half lengthwise, and sealed to form a pocket at each end. Various foams are used in forming these covers: a typical foam is polyurethane. The foam may be sealed at each end by a variety of techniques including, but not limited to: heat sealing, stapling, gluing, the application of adhesive tape, and sewing. The center portion of the foam cover typically defines an open slot or a hole which provides an opening for the insertion of the clothes hanger hook. After the hanger hook is inserted through this slot, both ends of the cover are then stretched and snapped in place over the ends of the hanger arms, thereby securing the cover to the hanger by means of elastic tension. After this installation of a foam cover on, for instance, a wire hanger, garments are held in place on the covered hanger more securely than on uncovered hangers.

While the previously discussed foam covers have proven very effective in eliminating garment slippage from clothes hangers, their use presents a continuing problem. Regardless of the manner or method in which the foam covers are provided to the garment care establishments, the present mode of foam cover installation requires that each foam cover, one at a time, be put on hangers with no mechanical assistance. This means that an operator must manually take up a coat hanger, thread the slot of the cover over the hanger hook and onto the neck thereof. Thereafter, the operator must hold or suspend the hanger while manually stretching the foam cover over each of the arms of the hanger and positioning the pocket at each end of the cover over the end of each arm. This procedure is repeated for each hanger so covered, and represents a significant expenditure in time and effort for a cleaning establishment which processes hundreds or thousands of garments daily.

What is needed is a method for rapidly and easily attaching currently available foam covers over various types of available clothes hangers. The method should effect the installation with less time and effort than current 'manual' methods, thereby resulting in significant savings in manpower and money. The apparatus to perform the method should be available at low cost. Finally, this apparatus should provide an efficient means of shipping hangar covers to end user, and for storing them thereat.

SUMMARY OF THE INVENTION

The present invention comprises a generally elongate insert blade which may be loaded with a supply of the previously described hanger covers. When folded to form this loop, the insert blade of the present invention forms a pocket at the lower end of the insert blade for receiving therein the hook of a clothes hanger. The lower portion of the insert blade just above the hook pocket is tapered outward on both sides to a location slightly below the hanger hook, thereby forming a stretcher which is wider than the hanger hook itself. At a generally upper end of the insert blade of the present invention is provided a suspension or anchor device for suspending the insert blade for use.

In use, the insert blade of the present invention is loaded with at least one and preferably a quantity of the previously described foam hanger covers by inserting the insert blade through the slot formed in each cover. The covers are loaded on the insert spindle such that the pockets formed by the sealed ends of the foam covers are pointed downwards. The anchored insert blade, thus loaded, is ready for use.

To load foam covers onto hangers using the method and apparatus of the present invention, the insert blade is suspended or anchored by the anchor device, and a clothes hanger hook is inserted into the hook pocket of the insert blade. An operator, grasping a foam cover at either end with the thumb and forefinger of each hand, and pulling or urging the cover with a downward and outward motion, will cause the foam cover to slide down the insert blade. When the open slot at the center of the foam cover encounters the tapered sides of the spreader, the spreader stretches the slot to an extent wider than the hanger hook width. The operator continues pulling in a downward and outward motion which causes the foam cover to be pulled off the insert blade and over the hanger hook onto the hanger neck. Continuing with the outward and downward pulling motion, the operator then guides the cover pockets over the arms of the clothes hanger, and snaps the foam cover pockets into place over the clothes hanger. The foam cover is now secured onto the hanger by the elastic tension of the cover maintaining the pockets in position over the hanger arms. At this point, the covered hanger is ready for use and may be removed from the insert blade.

This procedure is thereafter repeatable, with each new hanger being placed into the hook pocket and another cover installed thereon. This procedure may be repeated until the supply of foam covers loaded onto the insert blade is exhausted. Alternative embodiments of the previously discussed insert blade include forming the insert blade without a separate spreader element. In this case, the insert blade may or may not be formed of sufficient width so as to cause slot 10 to be stretched by the act of installing foam hanger cover 10 on shank 5. A further alternative could be the formation of shank 5 as a tapered element, thereby incorporating a spreader function onto shank 5 itself.

It will be appreciated from the preceding discussion, that the principles of the present invention are applicable not only to a methodology for the rapid loading of foam covers onto clothes hangers, but also provide a means for shipping and storing the foam covers.

Other features of the present invention are disclosed or apparent in the section entitled "BEST MODE OF CARRYING OUT THE PRESENT INVENTION".

BRIEF DESCRIPTION OF DRAWINGS

For fuller understanding of the present invention, reference is made to the accompanying drawing in the following detailed description of the Best Mode of Carrying Out the Present Invention. In the drawing:

FIG. 3 is a front view of an insert spindle according to the present invention, having the hook of a clothes hanger installed in the hook pocket thereof and having a foam cover loaded on the insert blade shank.

FIG. 4 is a front view of the insert spindle according to the present invention, showing the action of the spreader.

FIG. 5 is another front view of the insert blade according to the present invention showing the foam cover installed about the neck of the clothes hanger, but not yet installed on the arms thereof.

FIG. 6 details the completed installation of a foam cover on a clothes hanger according to the present invention.

Figure 1:
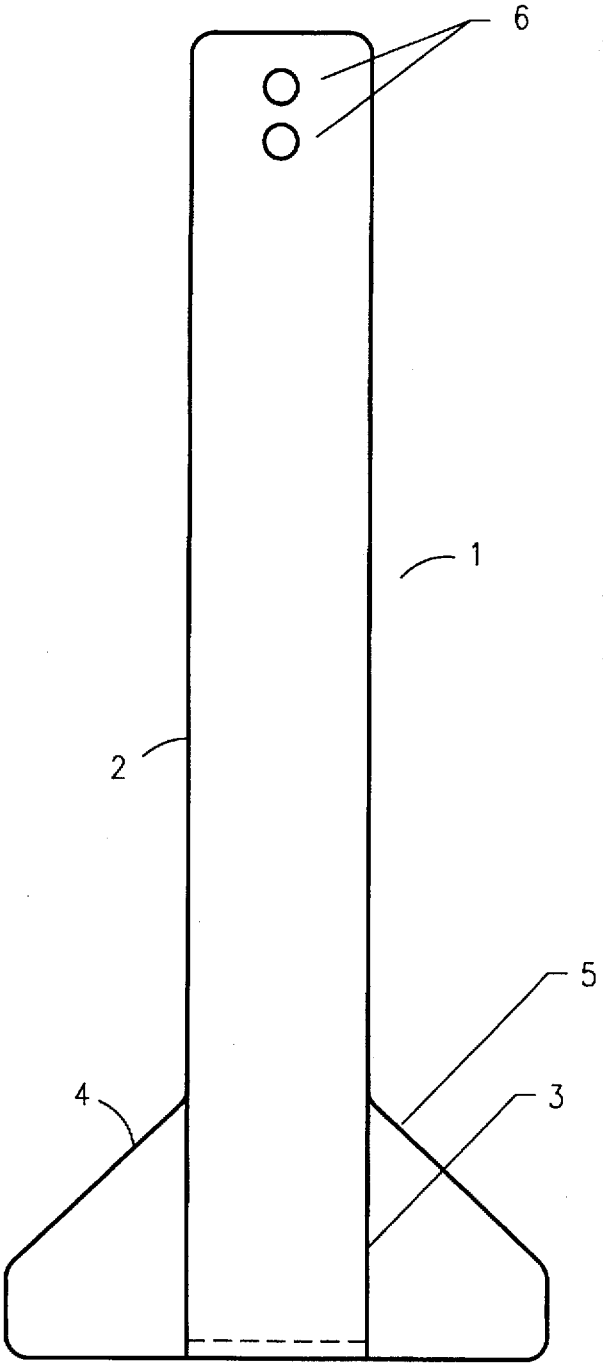
FIG. 1 is a front view of the insert spindle according to the present invention.

Reference numbers refer to the same or equivalent parts of the invention throughout the several figures of the drawing

BEST MODE FOR CARRYING OUT THE PRESENT INVENTION

Referring now to FIG. 1, a preferred embodiment of the present invention is shown. The insert spindle 1 of the present invention, in this embodiment takes the form of an elongate loop formed of pasteboard. An elongate shank 2, is defined by the loop and is utilized for shipping and storing foam covers thereon and for dispensing the same covers therefrom. The bottom of the elongate loop defines hook pocket 3 for receiving therein the hook of a clothes hanger (not shown). Disposed at a substantially lower end of at least one arm of the elongate loop and in operative combination with hook pocket 3 are a pair of spreaders, 4 and 5. Defined at a substantially upper end of insert blade 1 is at least one anchor hole 6.

Figure 2:
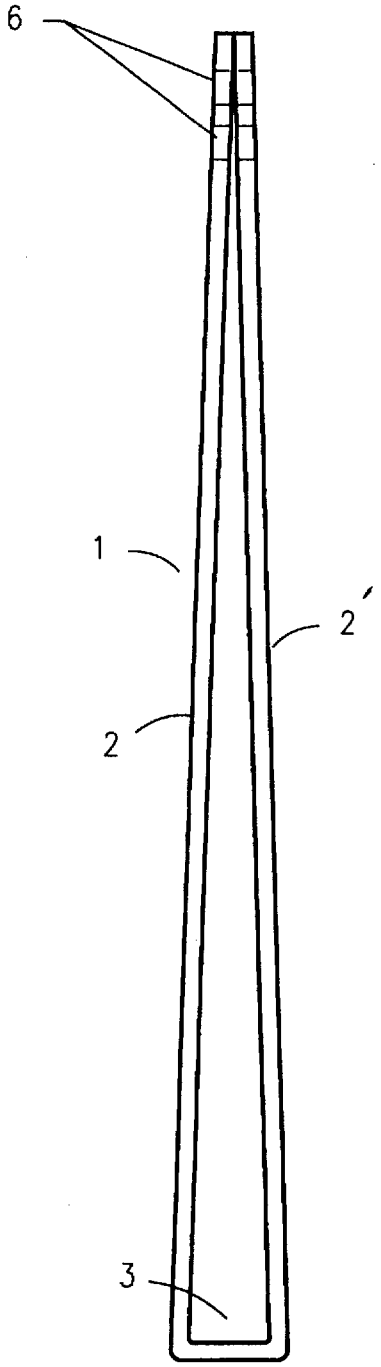
FIG. 2 is a side view of the insert blade of the present invention showing a side view of the hook pocket thereof.
Figure 3:
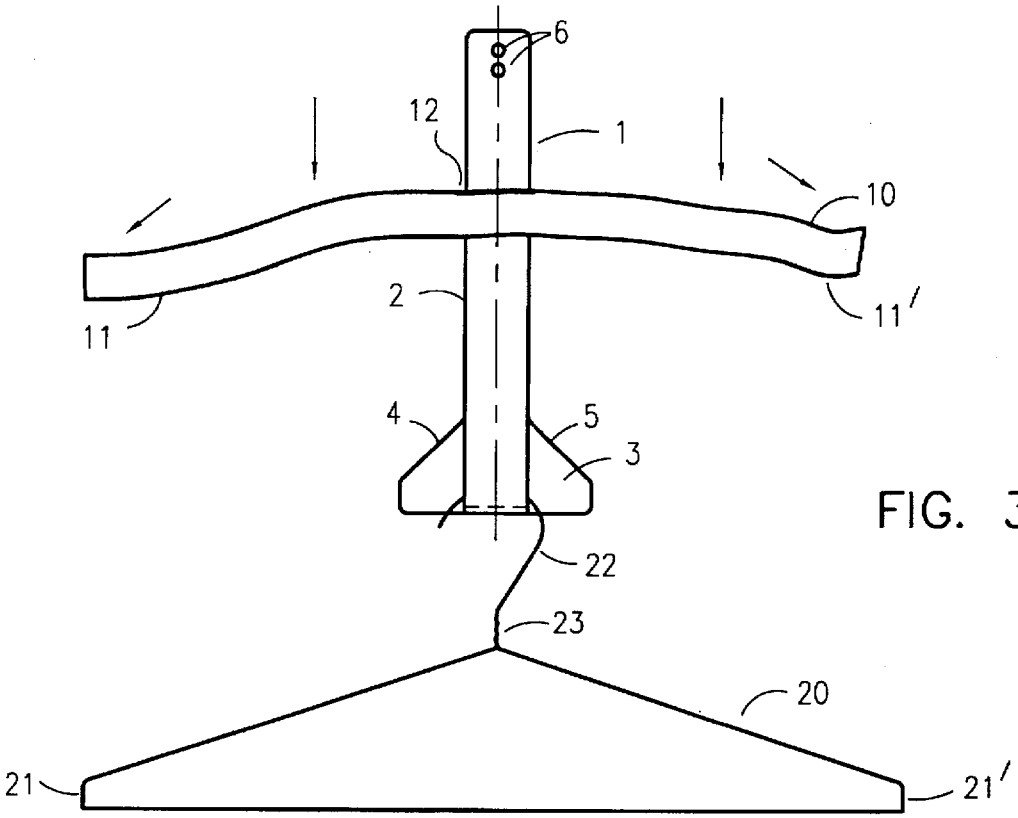
FIGS. 3 through 6 detail the method of installing foam covers on clothes hangers according to the present invention.

Referring now to FIG. 2, a side view of insert blade 1 of the present invention is shown. With reference to that figure, insert blade 1 is shown to be formed of the previously defined elongate loop defining shank arms 2 and 2'. The upper ends of the loop may be attached by adhesives, tape, or mechanical fasteners well known to those of ordinary skill in the art. At the lower end of the loop, shank arms 2 and 2' form hook pocket 3. Anchor holes 6 are shown disposed through each of shank arms 2 and 2'.

Referring now to FIGS. 3 through 6, the method of installing foam covers on clothes hangers according to the present invention is detailed. Having reference to FIG. 3, insert blade 1, having at least one foam hanger cover 10 is installed on shank 5 by inserting the insert shank through slot 12 of cover 10. Insert blade 1 is thereafter suspended by anchor holes 6. This suspension my be to any item the operator deems convenient; a clothes bar for instance. The hook, 22, of a clothes hanger, 20, is thereafter inserted by the operator (not shown) into hook pocket 3, and clothes hanger 20 is now suspended from insert blade 1. It will be appreciated that hook pocket 3, in operative combination with insert blade 1 maintains hanger 20 in substantial parallel and coplanar alignment with respect to the broad axis, or first surface, of insert blade 1. Further, that laterally flattened insert blade 1, being inserted into slot 12 of cover 10, maintains slot 12 and hence cover 10, in substantial alignment with respect to insert blade 1, spreader 5, hook pocket 3 and hook 22 of hanger 20. Hanger 20 also includes arms 21 and 21' and neck 23. As the operator grasps either end of hanger cover 10 with of the operator's respective thumbs and index fingers, the operator urges or pulls it downward and outward. As this outward and downward urging continues, it will cause slot 12 to encounter spreaders 4 and 5.

Figure 4:
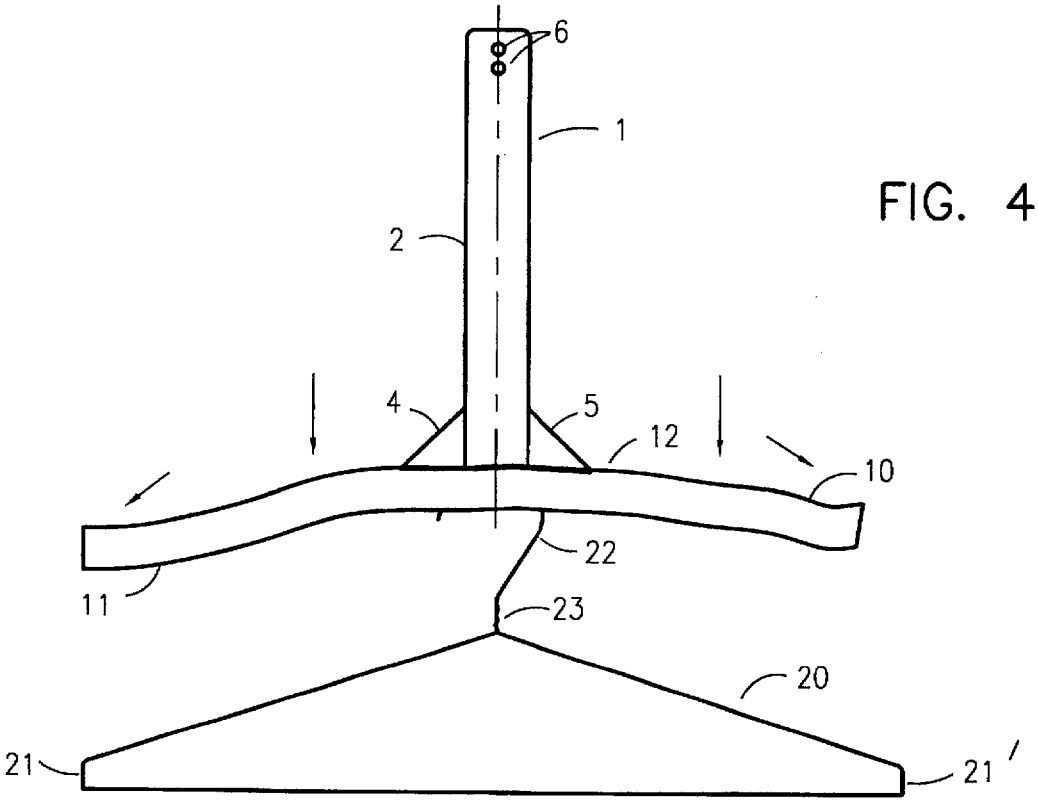

Referring now to FIG. 4, as the operator continues to pull hanger cover 10 in a downward direction, insert blade 1 in operative combination with hook pocket 3 maintains slot 12 and hence cover 10, in substantial coplanar alignment with respect to hook 22 of hanger 20. Further, at this point, 4 and 5 have spread slot 12 to an extent substantially wider than the width of hook 22. As the operator continues to pull hanger cover 10 in a downward direction, the spreaders will thus have spread the elongate hole or slot to an extent sufficient to pass over hook 22.

Figure 5:
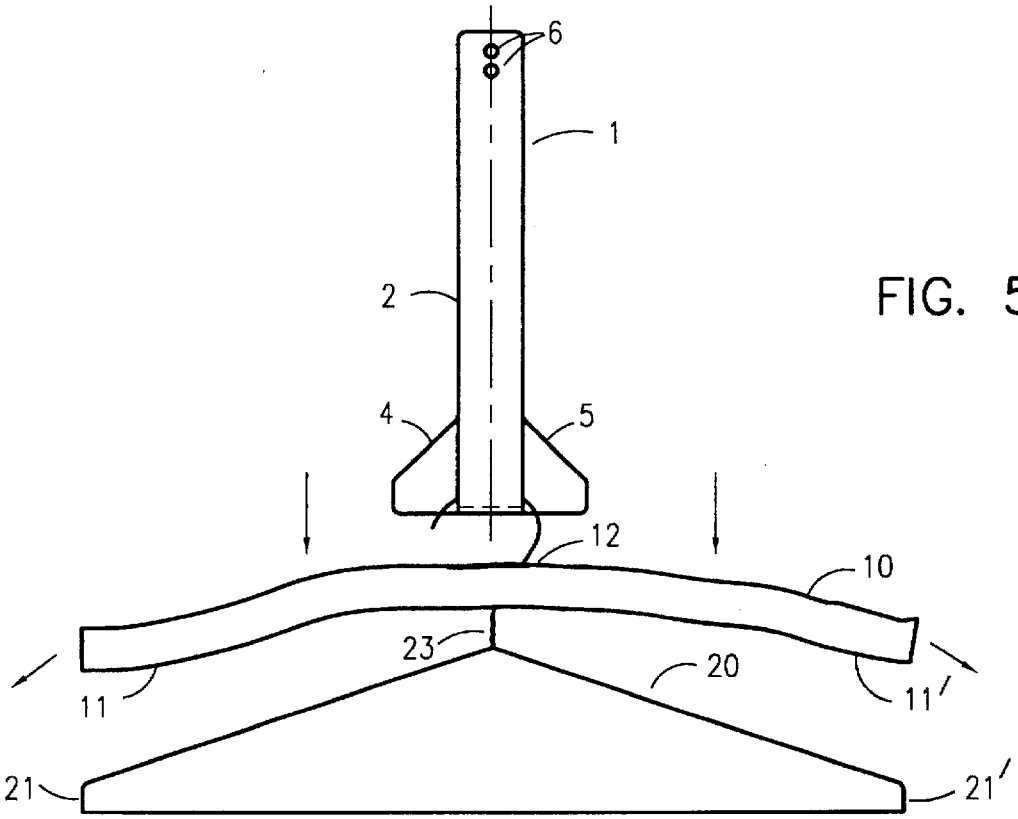

Having reference now to FIG. 5, hanger cover 10 has been inserted over hook 22 and is, at this point, substantially disposed about neck 23 of hanger 20. As the operator (not shown) continues to pull hanger cover 10 in a downward and outward direction, pockets 11 and 11' (formed by the sealing of either end of cover 10) are pulled over the ends of arms 21 and 21' of hanger 20. Once pulled over arms 21 and 21', the elastic tension of cover 10 serves to retain pockets 11 and 11', and hence cover 10 itself in position on hangar 20.

Figure 6:
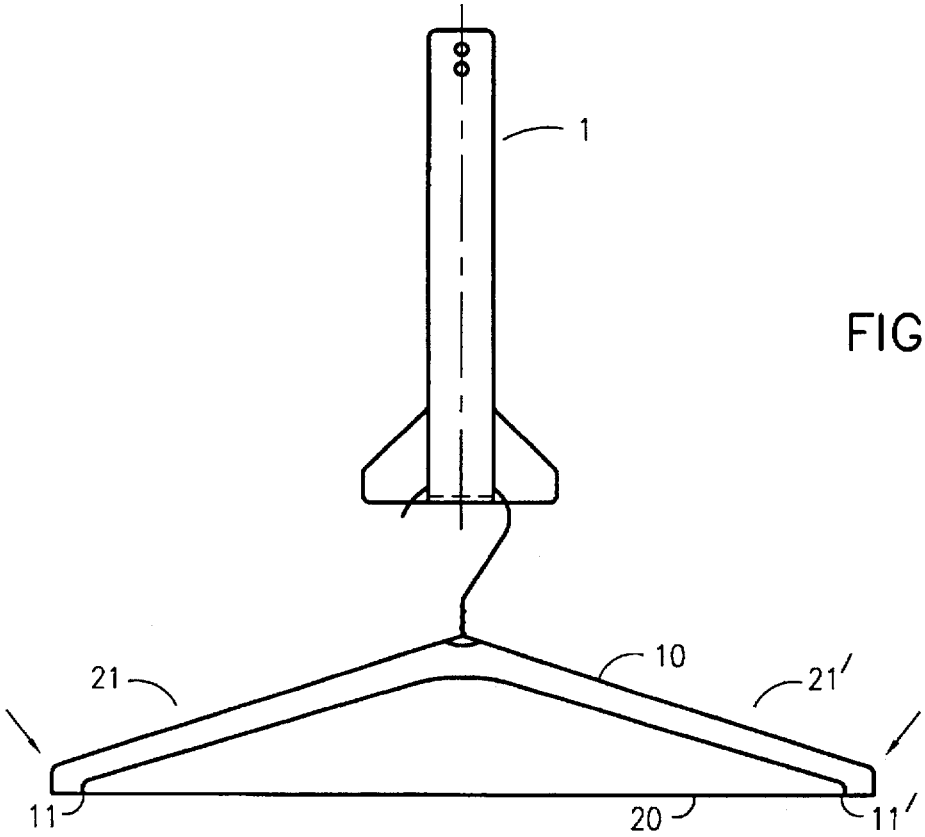

At FIG. 6, pockets 11 and 11' have been snapped over ends 21 and 21' and hanger cover 10 is shown completely installed upon hanger 20. At this point, hanger 20, having cover 10 disposed thereon, may be removed from insert spindle 1. It will be appreciated that a supply of hanger covers 10, comprising a plurality thereof may, with equal facility, be installed on insert blade 1. In this case, the steps detailed in FIGS. 3 through 6 may be repeated for each of the plurality of covers installed on insert blade 1 until they are exhausted.

The previously discussed preferred embodiment details an insert blade which is designed to be substantially disposable. It will be appreciated, therefore, that a manufacturer of foam covers could market those covers already loaded onto the insert blade of the present invention. In this case, the insert blade could be discarded when the covers are exhausted. As an alternative to this embodiment, the present invention specifically contemplates a non-disposable, re-loadable hanger cover insert blade. The design for this device would be substantially similar to that previously discussed, but could be made of a more substantial material. Examples of such material include but are not limited to; plastics, metals, fabrics, fiber reinforced resins and other materials well known to those of ordinary skill in the art. This embodiment could be further improved by the use of a spring steel wire spreader and a front-loading or other type of snap clip hanger in place of the previously discussed anchor holes. This embodiment would have the advantage not only of durability and continued use, but also a somewhat smoother action. As this design would allow an overall lesser coefficient of friction between the cover and the loader, this would add to ease of operation and speed of use.

To utilize this embodiment, the cover manufacturer could then provide foam covers loaded on a chipboard insert, allowing them to be reloaded on the insert blade and thus dispensed onto the clothes hangers as previously discussed. This version of insert would take the form of an elongate U-shaped member, with the closed portion of the loop at the top of the plurality of covers. To load the plurality of covers onto the re-usable insert blade herein disclosed, the operator would simply insert the upper end of the re-usable insert blade into the lower end of the cover insert and urge the plurality of foam covers from the insert onto the shank of the insert blade. The chipboard insert may then be discarded.

The present invention has been particularly shown and described with respect to certain preferred embodiments and features thereof. However, it should be readily apparent to those of ordinary skill in the art that various changes and modifications in form and detail may be made without departing from the spirit and scope of the invention as set forth in the appended claims. In particular, the use of alternative cover designs and materials, insert blade materials, spreader geometries, anchor methodologies, and hook pocket designs are specifically contemplated by the principles of the present invention. The inventions illustratively disclosed herein may be practiced without any element which is not specifically disclosed herein.

I claim:

1. Apparatus for installing a foam cover on a clothes hanger, the cover defining a slot, the hanger including a hook, the apparatus comprising:

an elongate cardboard insert blade, said insert blade including a shank portion for receiving thereon a plurality of said foam covers;

said elongate cardboard insert blade further defining a hook pocket including a transverse aperture at a substantially lower end of said insert blade for receiving therein said hook of said clothes hanger, and at least one suspension hole at a substantially upper end of said insert blade for suspending said insert blade; and a pair of outwardly tapering spreaders further disposed at a substantially lower end of said insert blade, and in operative combination with said hook pocket for spreading said foam cover over said hanger hook as said covers are urged downward along said shank portion and over said spreaders.

2. The method of installing a foam cover on a clothes hanger, said clothes hanger including a hook and two arms, said foam cover having a pocket at either end and defining therein a slot, the method comprising the steps of:

inserting an insert blade into said slot of said cover;

suspending said insert blade, having said cover inserted thereon, by a suspension means defined at a substantially upper end of said insert blade;

inserting said hook of said clothes hanger into a hook pocket defined at a substantially lower end of said insert blade, said insert blade including at least one spreader further disposed at a substantially lower end of said insert blade and in operative combination with said hook pocket;

grasping each end of said foam cover and pulling downward;

urging said foam cover toward said spreader;

continuing said urging step in a downward and outward direction, thereby causing said slot to engage said spreader and spreading said slot over said hook; and further continuing said urging step in a downward and outward direction engaging said pockets of said cover onto and over the ends of said arms of said hanger; and releasing said each of said ends of said foam cover such that said pockets is elastically engaged over the ends of said arms of said hanger.

3. Cover storage and installation apparatus for storing a clothes hanger cover and for installing said foam cover on a clothes hanger, the cover defining a slot, the apparatus comprising in operative combination:

a laterally flattened insert blade means for insertion into said slot of said cover and for receiving thereon said cover, said insert blade means defining a first surface and a first edge;

transverse hanger hook receiving means disposed at a substantially lower end of said insert blade means and substantially parallel with respect to said first surface, said hanger hook receiving means for receiving therein said hook of said clothes hanger and for maintaining said hanger substantially parallel and coplanar with respect to said first surface of said insert blade means;

said insert blade means and said hanger hook receiving means in operative combination forming means for retaining said cover on said blade, and, responsive to the downward urging by an operator, for installing said cover over said hook of said hanger;

outwardly and downwardly tapering spreader means further disposed at a substantially lower end of said insert spindle and in operative combination with said hanger hook receiving means for spreading said slot over said hanger hook; and suspension means, disposed at a substantially upper end of said insert blade means, for suspending said insert blade means.

4. Cover storage and installation apparatus for storing a clothes hanger cover and for installing said foam cover on a clothes hanger, the cover defining a slot, the hanger including a hook, the apparatus comprising:

a substantially flattened insert blade having a first surface, and including a shank portion sized to be insertable into said slot of said foam cover;

a hanger hook pocket defining a transverse aperture disposed substantially parallel and coplanar with respect to said first surface at a substantially lower end of said insert blade;

a suspension device disposed at a substantially upper end of said insert blade;

at least one outwardly and downwardly tapering spreader further disposed substantially parallel and coplanar with respect to said first surface at a substantially lower end of said insert blade;

whereby said hanger hook pocket and said spreader, in operative combination form a means for aligning said hook and said hanger with respect to said slot of said cover, and, responsive to downward and outward urging by an operator, for spreading said slot of said cover over said hook of said hanger.

5. The apparatus of claim 4 wherein said insert blade is formed of a material selected from the group consisting of: pasteboard; chipboard; plastics, metals; fabrics; and fiber-reinforced resins.

6. The apparatus of claim 4 wherein said spreader is formed of a material selected from the group consisting of: pasteboard; cardboard; chipboard; plastics, metals; fabrics; fiber-reinforced resins; and spring steel.

7. The apparatus of claim 4 wherein said suspension device further comprises said insert blade defining at least one hole at an upper end of said insert blade.

8. The apparatus of claim 4 wherein said suspension means further comprises a spring clip.

* * * * *